US006566852B2

(12) United States Patent
Tagami et al.

(10) Patent No.: US 6,566,852 B2
(45) Date of Patent: May 20, 2003

(54) VOLTAGE GENERATOR, OUTPUT CIRCUIT FOR ERROR DETECTOR, AND CURRENT GENERATOR

(75) Inventors: Hitoyuki Tagami, Tokyo (JP); Koichi Takizawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/921,870

(22) Filed: Aug. 6, 2001

(65) Prior Publication Data

US 2002/0036490 A1 Mar. 28, 2002

(30) Foreign Application Priority Data

Aug. 9, 2000 (JP) ..... 2000-241128

(51) Int. Cl.[7] ..... G05F 3/16
(52) U.S. Cl. ..... 323/316
(58) Field of Search ..... 323/312, 313, 323/314, 315, 316, 907; 327/530, 539

(56) References Cited

U.S. PATENT DOCUMENTS 4,559,488 A * 12/1985 Minakuchi ..... 323/281
4,928,056 A * 5/1990 Pease ..... 323/314
5,774,021 A * 6/1998 Szepesi et al. ..... 330/257
5,990,672 A * 11/1999 Giacomini ..... 323/313
6,400,212 B1 * 6/2002 Sakurai ..... 327/539

OTHER PUBLICATIONS

Seiko Denishi Kogyo Kabushiki Kaisha, High Output Current & High Precision Voltage Regulator, S–813 Series, p. 7, With English Translation "No date".

* cited by examiner

*Primary Examiner*—Adolf Deneke Berhane
(74) *Attorney, Agent, or Firm*—Birch, Stewart, Kolasch & Birch, LLP.

(57) ABSTRACT

The voltage generator includes the NPN transistor that flows a current corresponding to a voltage VOP output from the error detector. Furthermore, there is provided the current mirror circuit which includes two PNP transistors that flow currents which are multiples of the current that the NPN transistor flows. Furthermore, there are provided two resistors for generating a feedback voltage VFBK to the error detector from an output voltage VREG generated based on a current that the current mirror circuit flows.

18 Claims, 8 Drawing Sheets

103
203
1
VCC
2
GND
32
Iout5
Iin5
35
R21
34
37
R23
36
R22
33
31
42
44
41
I2
11
VREG6
3
43
R31
10
8
VOP
9
R3
5
VREF
VFBK
4
REFERENCE VOLTAGE GENERATOR
R2
7
R1
6

VOLTAGE GENERATOR, OUTPUT CIRCUIT FOR ERROR DETECTOR, AND CURRENT GENERATOR

FIELD OF THE INVENTION

The present invention relates to a voltage generator which outputs a constant voltage irrespective of temperature or power source voltage changes, an output circuit for an error detector that is used for this voltage generator, and a current generator for outputting a predetermined current. More particularly, this invention relates to a voltage generator, an output circuit for an error detector, and a current generator constituted by bipolar transistors.

BACKGROUND OF THE INVENTION

As a conventional voltage generator, there has been known a voltage generator structured by bipolar transistors. FIG. 8 is a diagram showing a schematic structure of a conventional voltage generator structured by bipolar transistors. This voltage generator consists of a reference voltage generator 54 for generating and outputting a constant reference voltage VREF irrespective of temperature or power source voltage changes, an error detector 55 having a negative-phase input connected to an output of the reference voltage generator 54, a PNP transistor 58 having an output of the error detector 55 connected to a base, having a high-potential side of the power source connected to an emitter, and having a collector connected to a voltage output terminal 53, a resistor 57 disposed between the voltage output terminal 53 and a positive-phase input of the error detector 55, and a resistor 56 disposed between the positive-phase input of the error detector 55 and a low-potential side (ground) 52 of the power source.

The reference voltage generator 54 generates a constant reference voltage VREF independent of a power source voltage and temperature. The reference voltage VREF can take only one value that satisfies a predetermined condition not to be independent of a power source voltage and temperature. As the reference voltage generator 54 has a large output impedance, an output voltage varies when a large output current flows. Therefore, only the reference voltage generator 54 is not sufficient for use as a voltage generator. Thus, the error detector 55, the PNP transistor 58, and the resistors 56 and 57 are also provided.

The PNP transistor 58 is disposed as an output buffer for obtaining a constant output voltage VREG8 independent of an output current, by reducing the output impedance. The error detector 55 is disposed as a feedback amplifier that inputs the reference voltage VREF and a feedback voltage VFBK from the reference voltage generator 54, amplifies the reference voltage VREF with a gain determined based on a ratio of a resistance R52 to a resistance R51 of the resistors 57 and 56, and outputs a voltage VOP. The output voltage VREG8 generated in the voltage output terminal 53 is expressed by equation 1.

$$\text{VREG8}=-(1+\text{R52}/\text{R51})\times VREF \quad (1)$$

In other words, the output voltage VREG8 is determined based on the reference voltage VREF and a resistance ratio (R52/R51) between the resistors 56 and 57. As the reference voltage VREF has no dependency on temperature and a power source voltage, the output voltage VREG8 does not depend on temperature and a power source voltage either. Even when the output current increases, for example, the output voltage VREG8 is kept at a constant value shown in equation 1 based on a feedback loop of the feedback amplifier. When the error detector 55 operates from rail to rail, a set range of the output voltage VREG8 becomes as follows. A minimum side of the range is a voltage of a low-potential side 52 of the power source becomes, and a maximum side is a voltage (VCC-Vcesat) obtained by subtracting a collector/emitter saturation voltage Vcesat (generally, about 0.3 V) of the PNP transistor 58 from a voltage VCC of a high-potential side 51 of the power source.

In other words, the output voltage of this voltage generator is set within a range from a low power source voltage (a voltage at the low-potential side of the power source) to (VCC-Vcesat). In general, a current multiplication factor of a PNP transistor is as small as about HFE=20 to 50. Therefore, for driving a large current based on the output voltage VREG8, a large driving capacity is necessary for the error detector 55. When the current multiplication factor of the PNP transistor 58 is 20, and also when the driving current of the output voltage VREG8 is 100 mA, the error detector 55 needs to have an output stage that can bear an inflow current of 5 mA.

FIG. 9 is a diagram showing a schematic structure of another conventional voltage generator structured by bipolar transistors. This voltage generator has an NPN transistor 61 in place of the PNP transistor of the voltage generator shown in FIG. 8, and has the input polarity of the error detector 55 changed to the opposite polarity (the reference voltage VREF is input in the positive phase, and the feedback voltage VFBK is input in the opposite phase). This voltage generator also operates in a similar manner to that of the voltage generator shown in FIG. 8, and outputs an output voltage VREG9 determined by resistors 56 and 57. However, in general, the current multiplication factor of an NPN transistor is large (HFE=about 100). Therefore, in the case of this voltage generator, the current driving capacity of an error detector 55 may be small even when a large current is driven based on the output voltage VREG9.

For example, when a driving current of the output voltage VREG9 is 100 mA, it is sufficient that the input stage of the error detector 55 can bear the inflow current of 1 mA. When the error detector 55 operates from rail to rail, a set range of the output voltage VREG9 becomes as follows. A minimum value side of the range is a low power source voltage, and a maximum side is a voltage obtained by subtracting a base/emitter voltage Vbe (generally, about 0.9 V) of the NPN transistor 61 from a high power source voltage (a voltage at the high-potential side of the power source) In other words, the output voltage of this voltage generator is set within a range from the low power source voltage to (VCC-Vbe).

Further, it is also possible to construct a current generator by providing a current source circuit at a rear stage of the voltage generator. FIG. 10 is a diagram showing a schematic structure of a conventional current source circuit. This current source circuit consists of a voltage input terminal 71 connected to the voltage output terminal 53 of the voltage generator shown in FIG. 8 or FIG. 9, for inputting the output voltage VREG8 (or 9) of the voltage generator, a resistor 75 (a resistance R71) having one end connected to the voltage input terminal 71, an NPN transistor 73 having the other end of the resistor 75 connected to a collector and a base, a resistor 76 (a resistance R72) provided between an emitter of the NPN transistor 73 and a low-potential side 52 of the power source, an NPN transistor 74 having a base of the NPN transistor 73 connected to a base, and having a collector connected to a current output terminal 72, and a resistor 77 (a resistance R73) provided between an emitter of the NPN transistor 74 and the low-potential side 52 of the power source.

This current source circuit outputs a current based on an input of the constant voltage VREG8 (or 9) independent of temperature and a voltage power source. The NPN transistors 73 and 74 constitute a current mirror current source circuit. When the sizes of the NPN transistors 73 and 74 and the resistances R72 and R73 of the resistors 76 and 77 are of the same values respectively, an input current Iin8 and an output current Iout8 of the current source circuit can be expressed by equation 2.

$$Iout8 = Iin8 \tag{2}$$

$$= [VREG8 - Vbe(T, Ie)]/(R71 + R72)$$

In equation 2, Vbe (T, Ie) represents a base/emitter voltage of the NPN transistors 73 and 74 respectively, and this can be expressed as a function of temperature T and an emitter current Ie.

Temperature characteristic dVbe/dT of the base/emitter voltage Vbe (T, Ie) can be expressed by equation 3.

$$dVbe/dT = -\{1.25 - Vbe(T, Ie)\}/T \tag{3}$$

In equation 3, (1.25−Vbe (T, Ie) ) becomes a negative value. Therefore, a positive and negative relationship of the temperature characteristic dVbe/dT becomes opposite to that of the temperature T. In other words, the base/emitter voltage Vbe (T, Ie) has a negative temperature characteristic (a characteristic that the value decreases along a rise in temperature)

Assuming that the resistors 75, 76 and 77 do not have temperature dependency, the temperature characteristic dIout8/dT of the output current Iout8 is expressed as shown by equation 4 from equation 2.

$$\mathrm{dIout8}/dT = -(dVbe/dT)/(\mathrm{R71}+\mathrm{R72}) \tag{4}$$

In equation 4, a positive and negative relationship of (dVbe/dT) becomes opposite to that of the temperature T. Therefore, dIoutt8/dT has the same positive and negative relationship as that of the temperature T. In other words, the output current Iout8 has a positive temperature characteristic (a characteristic that the value increases along a rise in temperature).

The resistors 76 and 77 are inserted in order to restrict manufacturing variations in the base/emitter voltages Vbe of the NPN transistors 73 and 74 respectively. When the voltage between terminals of the resistors 76 and 77 is designed as large as possible, it is possible to restrict the influence of manufacturing variations in the base/emitter voltages Vbe. In the mean time, in order to secure a large operating bias voltage in the functional circuit to be connected to the current output terminal 72, it is desired to take a small operating bias voltage Vib for operating the current generator. When the collector/emitter saturation voltage of the NPN transistor 74 is expressed as Vcesat, the operating bias voltage Vib can be expressed by equation 5.

$$Vib = Vcesat + \mathrm{Iout8} \times \mathrm{R73} \tag{5}$$

In other words, when the voltage between terminals (Iout8·R73) of the resistor 77 is as small as possible, it is possible to secure a large operating bias voltage for the functional circuit to be connected to the current output terminal 72. By taking into account the restriction of the influence of manufacturing variations in the base/emitter voltages Vbe and the securing of the operating bias voltage of the functional circuit to be connected to the current output terminal 72, the voltage between terminals of the resistors 76 and 77 is usually set to around 0.2 V.

However, according to the conventional voltage generator using PNP transistors, as the current multiplication factor of the output circuit (a circuit consisting of the PNP transistor 58) of the error detector 55 is small (HFE=about 20 to 50), it is necessary that the output stage of the error detector 55 can bear a large inflow current. As a result, there has been a problem that the output stage of the error detector 55 becomes complex, and the cost increases. Further, according to the conventional voltage generator using NPN transistors, an NPN transistor having a relatively large base/emitter voltage Vbe flows a large output current. Therefore, there has been a problem that a maximum value of a set range of the output voltage VREG9 is lowered, and the set range of the output voltage VREG9 becomes narrow.

Further, according to the conventional current generator, the current source circuit inputs the constant voltage VREG8 (or 9) independent of temperature and a voltage power source, and the NPN transistor 73 of which base/emitter voltage Vbe has a negative temperature characteristic flows the input current Iin8. Thus, the output current I out 8 has a positive temperature characteristic. Therefore, it has not been possible to generate a constant current irrespective of temperature or power source voltage changes. It has not been possible to generate a current having a negative temperature characteristic either.

SUMMARY OF THE INVENTION

It is an object of this invention to provide a voltage generator and an output circuit for an error detector capable of reducing cost and capable of expanding a set range of an output voltage. It is another object of this invention to obtain a current generator for generating a constant current irrespective of temperature or power source voltage changes, and a current generator for generating a current having a desired negative temperature characteristic.

The voltage generator according to one aspect of this invention comprises an NPN transistor for flowing a current corresponding to a voltage output from error detecting unit; a current mirror unit having a PNP transistor, for flowing a current that is a multiple of the current that the NPN transistor flows using the PNP transistor; and a resistor for generating a feedback voltage to the error detecting unit from an output voltage generated based on a current that the current mirror unit flows.

The voltage generator according to another aspect of this invention comprises a reference voltage output unit which outputs a constant reference voltage irrespective of temperature or power source voltage changes; an error detecting unit having an output of the reference voltage output unit connected to one input; an NPN transistor having an output of the error detecting unit connected to a base; a first resistor disposed between an emitter of the NPN transistor and a low-potential side of the power source;

a first PNP transistor having a collector of the NPN transistor connected to a collector and a base, and having a high-potential side of the power source connected to an emitter; a second PNP transistor having the base of the first PNP transistor connected to a base, and having the high-potential side of the power source connected to an emitter; a second resistor disposed between a collector of the second PNP transistor and the other input of the error detecting unit;

and a third resistor disposed between the other input of the error detecting unit and the low-potential side of the power source.

The voltage generator according to still another aspect of this invention comprises an NPN transistor for flowing a current corresponding to a voltage output from the error detection unit; and a current mirror unit having a PNP transistor, for flowing a current that is a multiple of the current that the NPN transistor flows using the PNP transistor.

The voltage generator according to still another aspect of this invention comprises an NPN transistor having an output of the error detection unit connected to a base; a first resistor disposed between an emitter of the NPN transistor and a low-potential side of the power source; a first PNP transistor having a collector of the NPN transistor connected to a collector and a base, and having a high-potential side of the power source connected to an emitter; and a second PNP transistor having the base of the first PNP transistor connected to a base, and having the high-potential side of the power source connected to an emitter.

The voltage generator according to still another aspect of this invention comprises a voltage generator which outputs a voltage that keeps a voltage of a feedback terminal constant irrespective of temperature or power source voltage changes; and a current source circuit having a terminal for determining an output current connected to a feedback terminal of the voltage generator, for outputting a current based on an output voltage of the voltage generator as an input.

The voltage generator according to still another aspect of this invention comprises a voltage generator which outputs a voltage that keeps a voltage of a feedback terminal constant irrespective of temperature or power source voltage changes; a first resistor having one end connected to a voltage output terminal of the voltage generator; a first NPN transistor having the other end of the first resistor connected to a collector and a base; a second resistor provided between an emitter of the first NPN transistor and a low-potential side of the power source; a second NPN transistor having a base of the first NPN transistor connected to a base; and a third resistor provided between an emitter of the second NPN transistor and the low-potential side of the power source, wherein the feedback terminal of the voltage generator is connected between the emitter of the first NPN transistor and the second resistor.

The voltage generator according to still another aspect of this invention comprises a voltage generator which outputs a voltage that keeps a voltage of a feedback terminal constant irrespective of temperature or power source voltage changes; a first resistor having one end connected to a voltage output terminal of the voltage generator; a first NPN transistor having the other end of the first resistor connected to a collector and a base; a second resistor provided between an emitter of the first NPN transistor and a low-potential side of the power source; a second NPN transistor having a base of the first NPN transistor connected to a base; and a third resistor provided between an emitter of the second NPN transistor and the low-potential side of the power source, wherein the feedback terminal of the voltage generator is connected between the emitter of the second NPN transistor and the third resistor.

The voltage generator according to still another aspect of this invention comprises a voltage generator which outputs a voltage that keeps a voltage of a feedback terminal constant irrespective of temperature or power source voltage changes; at least one diode connected in series between the voltage output terminal of the voltage generator and the feedback terminal of the voltage generator; and a current source circuit for outputting a current based on an output voltage of the voltage generator as an input.

The voltage generator according to still another aspect of this invention comprises a voltage generator which outputs a voltage that keeps a voltage of a feedback terminal constant irrespective of temperature or power source voltage changes; at least one diode connected in series between the voltage output terminal of the voltage generator and the feedback terminal of the voltage generator; a first resistor having one end connected to a voltage output terminal of the voltage generator; a first NPN transistor having the other end of the first resistor connected to a collector and a base; a second resistor provided between an emitter of the first NPN transistor and a low-potential side of the power source; a second NPN transistor having a base of the first NPN transistor connected to a base; and a third resistor provided between an emitter of the second NPN transistor and the low-potential side of the power source.

Other objects and features of this invention will become apparent from the following description with reference to the accompanying drawings.

DESCRIPTION OF THE PREFERRED EMBODIMENTS

Embodiments of this invention will be explained in detail below with reference to the accompanying drawings. These embodiments do not limit this invention.

Figure 1:
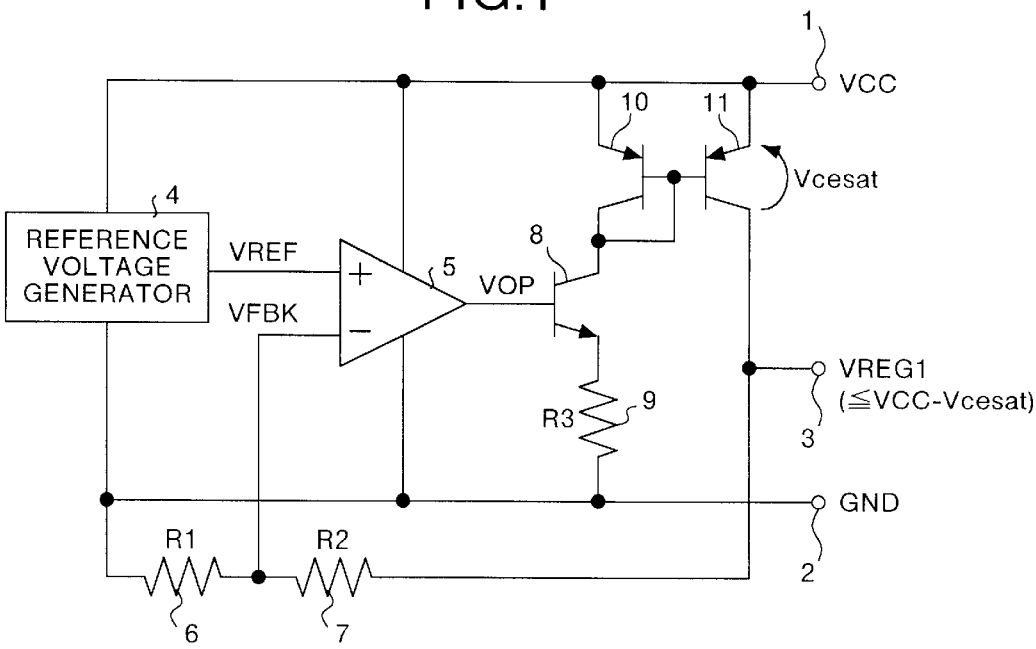
FIG. 1 is a diagram showing a schematic structure of a voltage generator relating to a first embodiment of this invention.

FIG. 1 is a diagram showing a schematic structure of a voltage generator relating to a first embodiment of this invention. This voltage generator is a voltage generator manufactured by a bipolar process, and consists of a reference voltage generator 4 for generating and outputting a reference voltage VREF substantially constant irrespective of temperature or power source voltage changes, an error detector (an operational amplifier) 5 having a positive-phase input connected to an output of the reference voltage generator 4, an NPN transistor 8 having an output of the error detector 5 connected to a base, a resistor 9 disposed between an emitter of the NPN transistor 8 and a low-potential side (ground) 2 of the power source, a PNP transistor 10 having a base and a collector connected to a collector of the NPN transistor 8, and having a high-potential side 1 of the power source connected to an emitter, a PNP transistor 11 having a base of the PNP transistor 10 connected to a base, having the high-potential side 1 of the power source connected to an emitter, and having a collector connected to a voltage output terminal 3, a resistor 7 disposed between the voltage output terminal 3 and a negative-phase input of the error detector 5, and a resistor 6 disposed between the negative-phase input of the error detector 5 and the low-potential side 2 of the power source.

The error detector 5 inputs a reference voltage VREF and a feedback voltage VFBK from the reference voltage generator 4, and outputs a voltage VOP corresponding to a difference between the input voltages. The NPN transistor 8 flows an emitter current corresponding to the voltage VOP from the error detector 5, to the resistor 9 (resistance R3). The PNP transistors 10 and 11 constitute a current mirror circuit. When a ratio of areas of emitters between the PNP transistors 10 and 11 is expressed as n, the multiplication factor of this current mirror circuit becomes n.

The PNP transistor 10 flows a collector-current of a value substantially equal (although there is a slight difference in a base current component of the transistor) to the current that flows through the resistor 9. The PNP transistor 11 flows a collector current (an output current) obtained by multiplying by n the collector current that the PNP transistor 10 flows. An output voltage VREG1 is generated in the voltage output terminal 3 based on the collector current that the PNP transistor 11 flows. The resistors 6 and 7 have resistances R1 and R2 respectively, and generate a feedback voltage VFBK to the error detector based on the output voltage VREG1.

Figure 2:
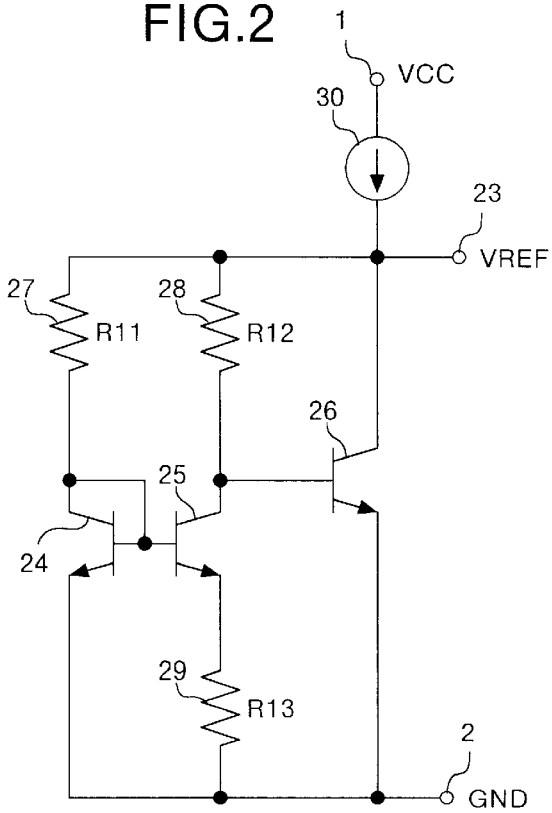
FIG. 2 is a circuit diagram showing a schematic structure of the reference voltage generator shown in FIG. 1.

FIG. 2 is a circuit diagram showing a schematic structure of the reference voltage generator 4 shown in FIG. 1. The reference voltage generator 4 consists of a current source 30 disposed between a high-potential side 1 of the power source and a voltage output terminal 23 of the reference voltage generator 4, an NPN transistor 26 having a collector connected to the voltage output terminal 23 and having a low-potential side 2 of the power source connected to an emitter, a resistor 28 disposed between the voltage output terminal 23 and a base of the NPN transistor 26, a resistor 27 having one end connected to the voltage output terminal 23, an NPN transistor 24 having the other end of the resistor 27 connected to a collector and a base, and having the low-potential side 2 of the power source connected to an emitter, an NPN transistor 25 having a base of the NPN transistor 24 connected to a base, and having a collector connected to the base of the NPN transistor 26, and a resistor 29 disposed between an emitter of the NPN transistor 25 and the low-potential side 2 of the power source.

Base/emitter voltages of the NPN transistors 24, 25 and 26 are expressed as Vbe11, Vbe12, and Vbe13 respectively. Emitter currents (=collector currents) of the NPN transistors 24, 25 and 26 are expressed as IE11, IE12, and IE13 respectively. A thermal voltage is expressed as VT. Resistances of the resistors 27, 28 and 29 are expressed as R11, R12, and R13 respectively. In this case, voltages at both ends of the resistor 27 become (VREF-Vbe11), and voltages at both ends of the resistor 28 become (VREF-Vbe13).

When (Vbe11=Vbe13), equation 6 is established.

$$R11 \cdot IE11 = R12 \cdot IE12 \tag{6}$$

The emitter voltage of the NPN transistor 25 is expressed by equation 7.

$$\begin{aligned} R13 \cdot IE12 &= Vbe11 - Vbe12 \\ &= VT \cdot 1n(IE11/IE12) \\ &= VT \cdot In(R12/R11) \end{aligned} \tag{7}$$

The reference voltage VREF is expressed by equation 8.

$$VREF = R12 \cdot IE12 + Vbe13 \tag{8}$$

Equation 9 is established from equations 7 and 8.

$$VREF = (VT \cdot R12/R13) \cdot 1n(R12/R11) + Vbe13 \tag{9}$$

The thermal voltage VT is expressed by equation (10)

$$VT = (k \cdot T)/q \tag{10}$$

where k represents a Boltzmann constant, T represents an absolute temperature, and q represents a charge.

In general, a temperature characteristic dVbe/dT of the base/emitter voltage Vbe of the NPN transistor is expressed by equation 11.

$$dVbe/dT = -(1.25 - Vbe)/T \tag{11}$$

When there is no temperature dependency based on the addition of a voltage of V1 to this Vbe, equation 12 is established.

$$-(1.25 - Vbe)/(T + dV1/dT = 0 \tag{12}$$

Equations 13 and 14 give conditions that satisfy equation 12.

$$V1 = m \cdot T \tag{13}$$

$$V1 + Vbe = 1.25 \tag{14}$$

where m represents a constant.

It can be understood from equations 9, 10, 13, and 14 that the reference voltage VREF has no temperature dependency, when the R11, R12 and R13 are set such that the reference voltage VREF becomes 1.25 V. It can be also understood from equation 9 that the reference voltage VREF has no power-source voltage dependency either, when the Vbe13 does not change based on the power source voltage. As explained above, it is possible to generate the reference voltage VREF that is not dependent on temperature and a power source voltage.

The operation of the first embodiment will be explained here. In the operation of the first embodiment, the reference voltage VREF of 1.25 V is generated by the reference voltage generator 4, and this is input to the positive-phase input of the error detector 5. The feedback voltage VFBK of which resistance has been divided by the resistor 6 and the resistor 7 is input to the negative-phase input. Therefore, when the output voltage VREG1 is lowered for some reason like a sudden increase in the output current, for example, the feed back voltage VFBK is lowered, and the output voltage VOP of the error detector 5 increases.

When the base/emitter voltage of the NPN transistor 8 is Vbe20, the emitter voltage of the NPN transistor 8 is (VOP-Vbe20). As the emitter of the NPN transistor 8 is connected to the low-potential side 2 of the power source via the resistor 9, the emitter current IE20 of the NPN transistor 8 increases. When the increase of the output voltage VOP is ΔVOP, and also when the increase of the emitter current IE20 is ΔIE20, the relationship of ( ΔIE20=ΔVOP/R3) is obtained.

The base current of the transistor is very small as compared with the emitter current. Therefore, when this base current is disregarded, the collector current equal to the emitter current IE20 flows to the collector and the emitter of the PNP transistor 10. Then, the collector current of the PNP transistor 11 becomes n times the collector current of the PNP transistor 10. In other words, the collector current of the PNP transistor 11 becomes n·IE20, and the collector current of the PNP transistor 10 also increases. Based on the increase in the collector current of the PNP transistor 10, the output voltage VREG1 increases. In this way, the feedback loop of the error detector 5 operates, and the output voltage VREG1 is kept constant.

As described above, according to the first embodiment, the current is multiplied (about 100 times) by the NPN transistor 8. Further, the current is multiplied (n times) by the current mirror circuit consisting of the PNP transistors 10 and 11. Therefore, it is possible to drive a large current based on the output voltage VREG1, even when the current driving capacity of the error detector 5 is low. For example, when the driving current of the output voltage VREG1 is 100 mA, and when the current multiplication factor of the current mirror circuit is 5, it is sufficient that the output stage of the error detector 5 can bear the inflow current of 0.2 mA. Therefore, it is possible to make simple the structure of the output stage of the error detector 5, and thus it is possible to reduce cost.

Further, the PNP transistor having a relatively small (in general, about 0.3 V) collector/emitter saturation voltage Vcesat flows the output current. Therefore, when the error detector 5 operates from rail to rail, the set range of the output voltage VREG1 determined by the resistance ratio of the resistors 6 and 7 becomes from (VCC-Vcesat) as the maximum side to the low power source voltage (a voltage at the low-potential side of the power source) as the minimum side. In other words, the set range of the output voltage VREG1 expands. As explained above, according to the first embodiment, it is possible to satisfy both a wide-range setting of the output voltage and the current driving capacity at the same time.

In the first embodiment, it has been assumed that the collector of the PNP transistor 11 is connected to the low-potential side 2 of the power source via the resistors 7 and 6. It is also possible that the collector of the PNP transistor 11 is connected to the low-potential side 2 of the power source via a further separate resistor, thereby to adjust the bias current of the PNP transistor 11. Further, in the first embodiment, explanation has been made based on a voltage generator as an example. It is also possible that a circuit consisting of the NPN transistor 8, the resistor 9, and the PNP transistors 10 and 11 is used as an output circuit for an error detector capable of satisfying both a wide-range setting of the output voltage and the current driving capacity at the same time.

Figure 3:
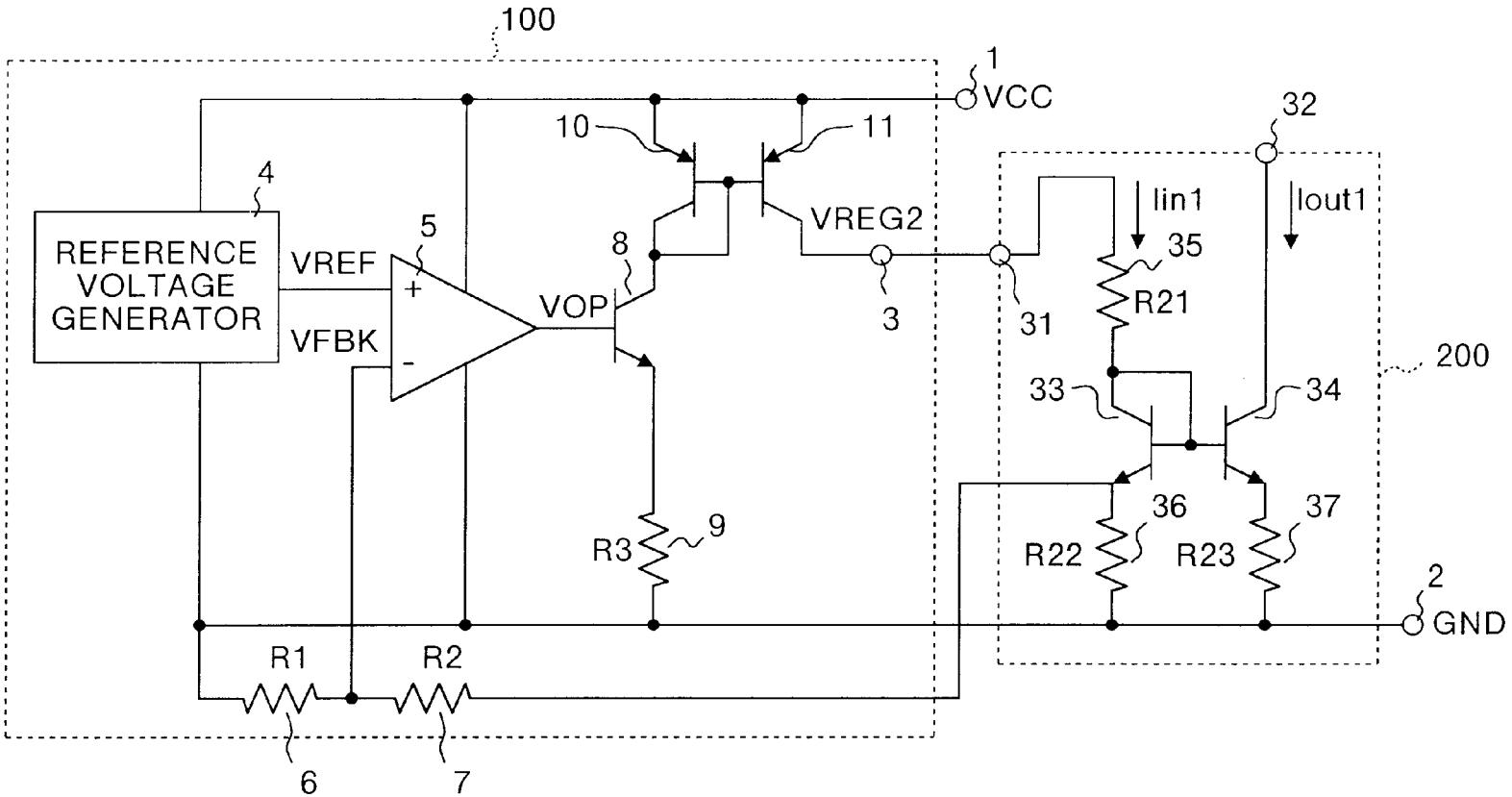
FIG. 3 is a diagram showing a schematic structure of a current generator relating to a second embodiment of this invention.

FIG. 3 is a diagram showing a schematic structure of a current generator relating to a second embodiment of this invention. Portions having the same structures as those in FIG. 1 are attached with like reference symbols. This current generator has a current source circuit 200 for outputting a predetermined current connected to a rear stage of a voltage generator 100 for generating a predetermined voltage.

The current source circuit 200 consists of a resistor 35 (a resistance R21) having one end connected to a voltage output terminal 3 of the voltage generator 100 via a voltage input terminal 31, an NPN transistor 33 having the other end of the resistor 35 connected to a collector and a base, a resistor 36 (a resistance R22) provided between an emitter of the NPN transistor 33 and a low-potential side 2 of the power source, a current output terminal 32 connected to a functional circuit not shown, for supplying a current to this functional circuit, an NPN transistor 34 having a collector connected to the current output terminal 32, and having a base and a collector of the NPN transistor 33 connected to a base, and a resistor 37 (a resistance R23) provided between an emitter of the NPN transistor 34 and the low-potential side 2 of the power source.

The voltage generator 100 is a one that has one end of the feedback resistor 7 connected between the emitter of the NPN transistor 33 and the resistor 36, without connecting to the voltage output terminal 3, in the voltage generator of the first embodiment shown in FIG. 1. Alternatively, one end of the feedback resistor 7 may be connected between the emitter of the NPN transistor 34 and the resistor 37.

The operation of current generator of the second embodiment will be explained here. In this current generator, the collector current of the PNP transistor 11 flows to the low-potential side 2 of the power source via the resistor 35, the NPN transistor 33, and the resistor 36, so that an output voltage VREG2 of the voltage generator 100 is generated. However, the sum of the resistances R1 and R2 of the resistors 6 and 7 is sufficiently large as compared with the resistance R22 of the resistor 36. Therefore, a current that flows to the low-potential side 2 of the power source via the resistors 6 and 7 can be disregarded.

When the sizes of the NPN transistors 33 and 34 are the same, and also when the resistances R22 and R23 of the resistors 36 and 37 are the same, an input current Iin1 and an output current Iout1 of the current source circuit 200 become equal. When the resistors 36 and 37 have no temperature dependency, an emitter voltage Ve1 of the NPN transistor 33 and a temperature characteristic dVe1/dT of the emitter voltage Ve1 are expressed by equation 15 and equation 16 respectively.

$$Ve1=Iin1\cdot R22=Iout1\cdot R23 \tag{15}$$

$$dVe1/dT=R22\cdot dIin1/dT=R23\cdot dIout1/dT \tag{16}$$

where dIin1/dT represents a temperature characteristic of the input current iin1, and dIout1/dT represents a temperature characteristic of the output current I out 1.

A voltage VFBK at a connection point between the resistor 6 and the resistor 7 is feedback controlled so that the voltage VFBK becomes equal to a reference voltage VREF that is stable independent of a power source voltage and temperature. As a result, the voltage Ve1 of the emitter of the NPN transistor 33 connected to the resistor 7 is controlled to be stable independent of a power source voltage and temperature. In other words, the temperature characteristic dVe1/dT of the emitter voltage Ve1 becomes "0". From equation 16, the temperature characteristic dIout1/dT of the output current Iout1 also becomes "0", and the output current Iout1 does not have temperature dependency.

It is also possible to arrange such that the output current has no temperature dependency when one end of the resistor 7 is connected to the emitter of the NPN transistor 34 instead of the emitter of the NPN transistor 33. Further, a voltage generator shown in FIG. 8 and FIG. 9 may be used in place of the voltage generator 100. In other words, the voltage output terminal 53 is connected to the voltage input terminal 31, and one end of the resistor 57 is connected to the emitter of the NPN transistor 33 or to the emitter of the NPN transistor 34, instead of connecting to the voltage output terminal 53. With this arrangement, it is also possible to avoid the temperature dependency of the output current.

As described above, according to the second embodiment, the voltage generator 100 outputs the voltage VREG2 for keeping constant the voltage of one end (feedback terminal) of the feedback resistor 7 irrespective of temperature or power source voltage changes. The current source circuit 200 inputs the output voltage VREG2 of the voltage generator 100, and connects the emitter (a terminal based on the voltage of which the output current Iout1 is determined, irrespective of temperature or power source voltage changes) of the NPN transistor 33 to the feedback terminal of the voltage generator 100. With this arrangement, the emitter voltage Ve1 of the NPN transistor 33 is kept constant irrespective of temperature or power source voltage changes. Therefore, it is possible to generate the output current Iout1 that is constant irrespective of temperature or power source voltage changes.

Figure 4:
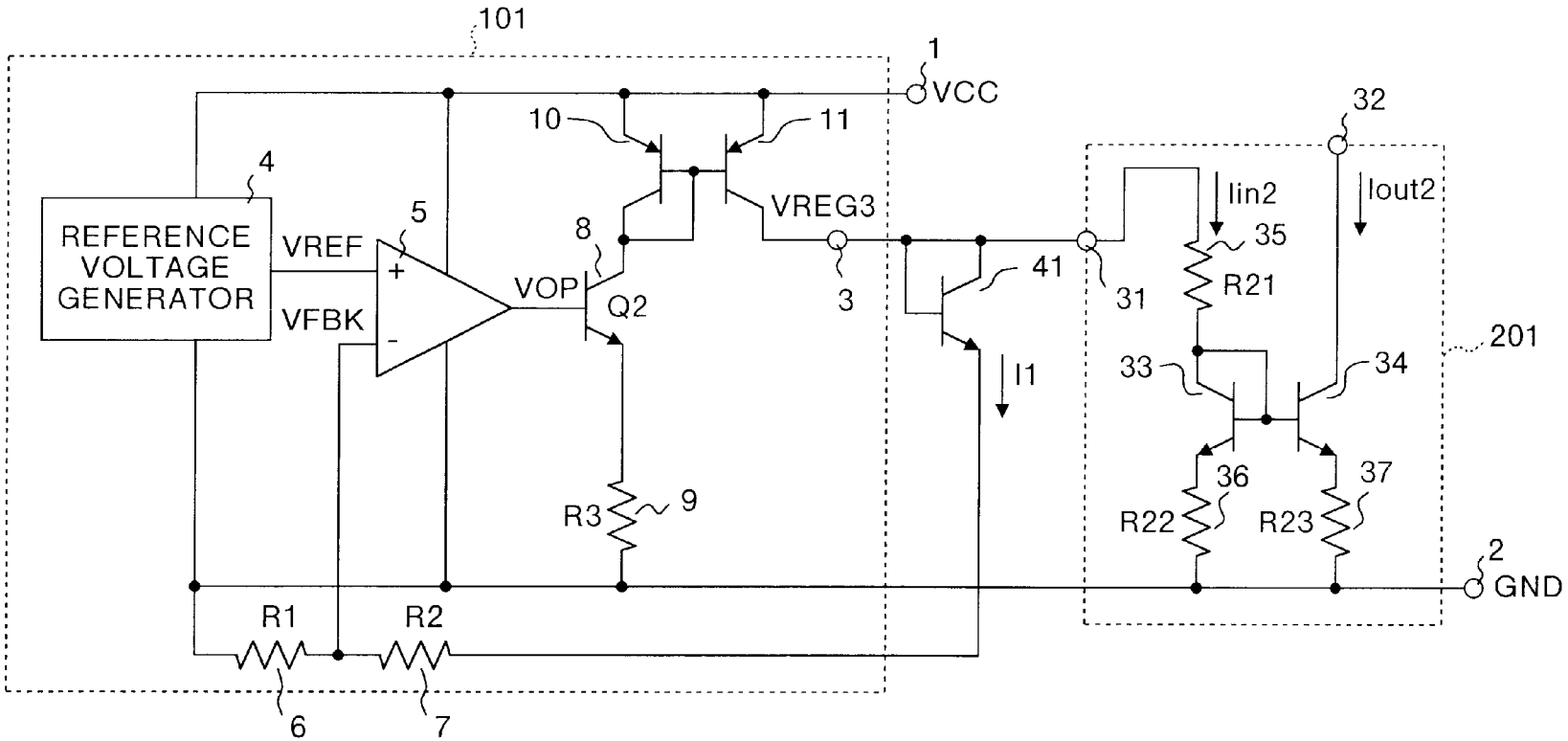
FIG. 4 is a diagram showing a schematic structure of a current generator relating to a third embodiment of this invention.

FIG. 4 is a diagram showing a schematic structure of a current generator relating to a third embodiment of this invention. Portions having the same structures as those in FIG. 3 are attached with like reference symbols. This current generator consists of a voltage generator 101 for generating a predetermined voltage, a current source circuit 201 disposed at a rear stage of the voltage generator 101, for outputting a predetermined current, a current source circuit 201 disposed at a rear stage of the voltage generator 101, for outputting a predetermined current, and an NPN transistor 41 having a connection point between the voltage generator 101 and the current source circuit 201 connected to a collector and a base, for feeding back the emitter output to the voltage generator 101.

The current source circuit 201 is a one that has one end of the resistor 7 not connected in the current source circuit 200 of the second embodiment shown in FIG. 3. The voltage generator 101 is a one that has one end of the resistor 7 connected to the emitter of the NPN transistor 41 in the voltage generator 100 of the second embodiment shown in FIG. 3. A collector and a base of the NPN transistor 41 are connected to the voltage output terminal 3 of the voltage generator 101 (or the voltage input terminal 31 of the current source circuit 201). The NPN transistor 41 operates as a diode.

The operation of the current generator according to the third embodiment will be explained here. In this current generator, a collector current of the PNP transistor 11 flows to a low-potential side 2 of the power source through two routes, so that an output voltage VREG3 of the voltage generator 101 is generated. The two routes include a route through which a current Iin2 flows via a resistor 35, an NPN transistor 33, and a resistor 36, and a route through which a current I1 flows via the NPN transistor 41,a resistor 6, and the resistor 7.

When the resistors 6 and 7 have no temperature dependency, an emitter voltage Ve2 and a temperature characteristic dVe2/dT of the NPN transistor 41 are expressed by equation 17 and 18 respectively.

$$Ve2=I1\cdot(R1+R2) \tag{17}$$

$$dVe2/dT=(R1+R2)\cdot dI1/dT \tag{18}$$

where dI1/dT represents a temperature characteristic of the current I1.

A voltage VFBK at a connection point between the resistor 6 and the resistor 7 is feedback controlled so that the voltage VFBK becomes equal to a reference voltage VREF that is stable independent of a power source voltage and temperature. As a result, the voltage Ve2 of the emitter of the NPN transistor 41 connected to the resistor 7 is controlled to be stable independent of a power source voltage and temperature. In other words, the temperature characteristic dVe2/dT of the emitter voltage Ve2 becomes "0". From equation 18, the temperature characteristic dI1/dT of the output current I1 also becomes "0", and the output current I1 does not have temperature dependency.

When the base/emitter voltage of the NPN transistor 41 is Vbe1, the current I1 is expressed by equation 19.

$$I1=(VREG3-Vbe1)/(R1+R2) \tag{19}$$

When the base/emitter voltage of the NPN transistor 33 is Vbe2, the current Iin2 is expressed by equation 20.

$$Iin2=(VREG3-Vbe2)/(R21+R22) \tag{20}$$

When (R21+R22) and (R1+R2) are of the same values, and also when the base/emitter voltages Vbe1 and Vbe2 are of the same values by matching the sizes of the NPN transistors 33 and 41, the current I1 becomes be equal to the current Iin2. As the input current Iin2 and the output current I out 2 are equal based on the operation principle of the current mirror current source, the output current Iout2 becomes equal to the current I1. As a result, the output current Iout2 has no temperature dependency.

Figure 5:
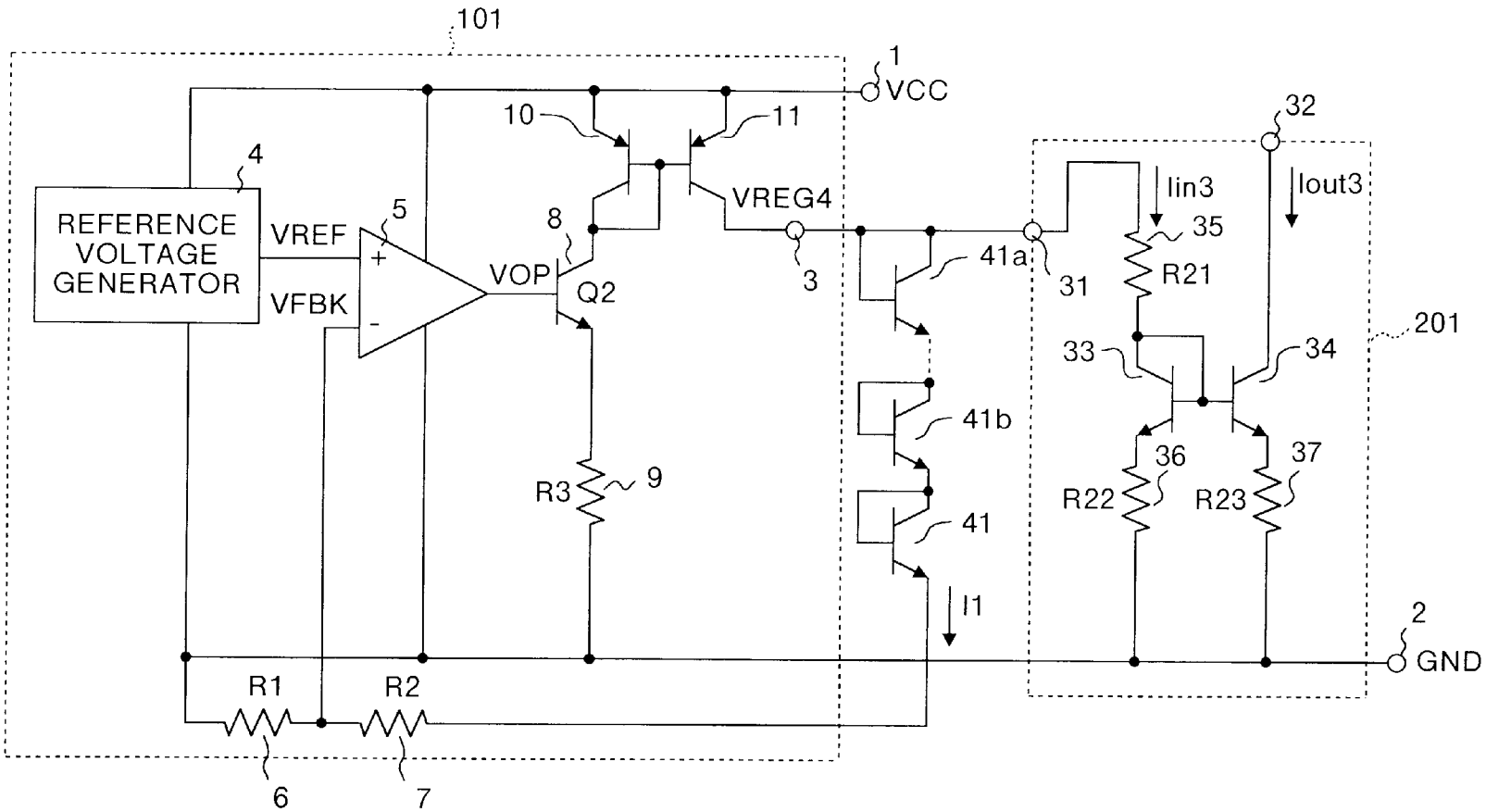
FIG. 5 is a diagram showing a schematic structure of another current generator relating to the third embodiment of this invention.

Further, when one or a plurality of diodes (NPN transistors connected in diode) are connected in series between the NPN transistor 41 and the voltage output terminal 3 (or the voltage input terminal 31), it is possible to generate an output current of a negative temperature characteristic. FIG. 5 is a diagram showing a schematic structure of other current output unit relating to the third embodiment. Portions having the same structures as those in FIG. 4 are attached with like reference symbols. This voltage generator is a one having a plurality of NPN transistors 41*a* to 41*b* diode-connected in series between the NPN transistor 41 and the output terminal 3 (or the voltage input terminal 31) in the voltage generator shown in FIG. 4.

The sizes of the NPN transistors 41*a* to 41*b* are set the same as those of the NPN transistor 41. In this case, a voltage Ve2 of an emitter of the NPN transistor 41 connected to one end of the resistor 7 and a temperature characteristic dVe2/dT of this can also be expressed by equations 17 and 18 respectively. The current I1 that flows through the NPN transistors 41*a* to 41*b* and 41 is not dependent on a power source voltage and temperature. When the output voltage of the voltage generator 101 is VREG4, the current I1 is expressed by equation 21.

$$I1=[VREG4-(N+1)\cdot Vbe1]/(R1+R2) \tag{21}$$

where N represents a number of the NPN transistors 41*a* to 41*b*.

An input current Iin3 and an output current Iout3 of the current source circuit 201 are expressed by equation 22.

$$\begin{aligned} Iout3 &= Iin3 \\ &= (VREG4 - Vbe2)/(R21 + R22) \end{aligned} \tag{22}$$

When the base/emitter voltages Vbe1 and Vbe2 are equal, and also when the VREG4 in equations 21 and 22 is arranged, equation 23 is obtained.

$$\text{Iout3}\cdot(\text{R21}+\text{R22})=\text{I1}\cdot(\text{R1}+\text{R2})+N\cdot\text{Vbe1} \quad (23)$$

Equation 21 is differentiated with respect to the temperature T. Considering that the current I1 is not dependent on temperature (the temperature characteristic dI1/dT of the current I1 is "0"), then equation 24 is obtained.

$$(R21+R22)\cdot dIout3/dT=(R1+R2)\cdot dI1/dT+N\cdot dVe1/dT \quad (24)$$

$$=N\cdot dVeb1/dT$$

As the base/emitter voltages Vbe1 of the NPN transistors 41*a* to 41*b* and 41 have a negative temperature characteristic, the output current Iout3 also has a negative temperature characteristic. It is possible to adjust the temperature characteristic of the output current Iout2 to a desired level by adjusting the number N of the NPN transistors 41*a* to 41*b*.

Figure 7:
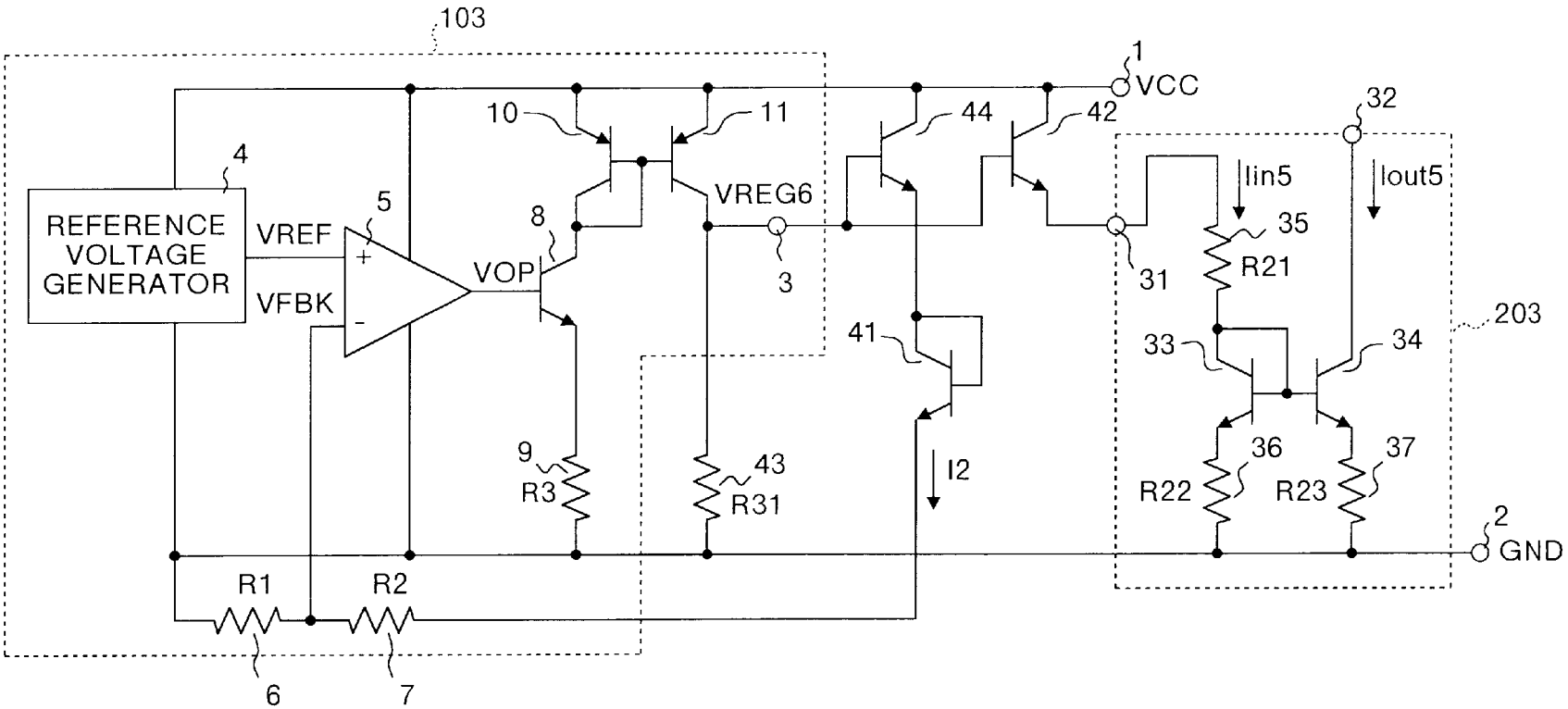
FIG. 7 is a diagram showing a schematic structure of a current generator relating to a fifth embodiment of this invention.
Figure 8:
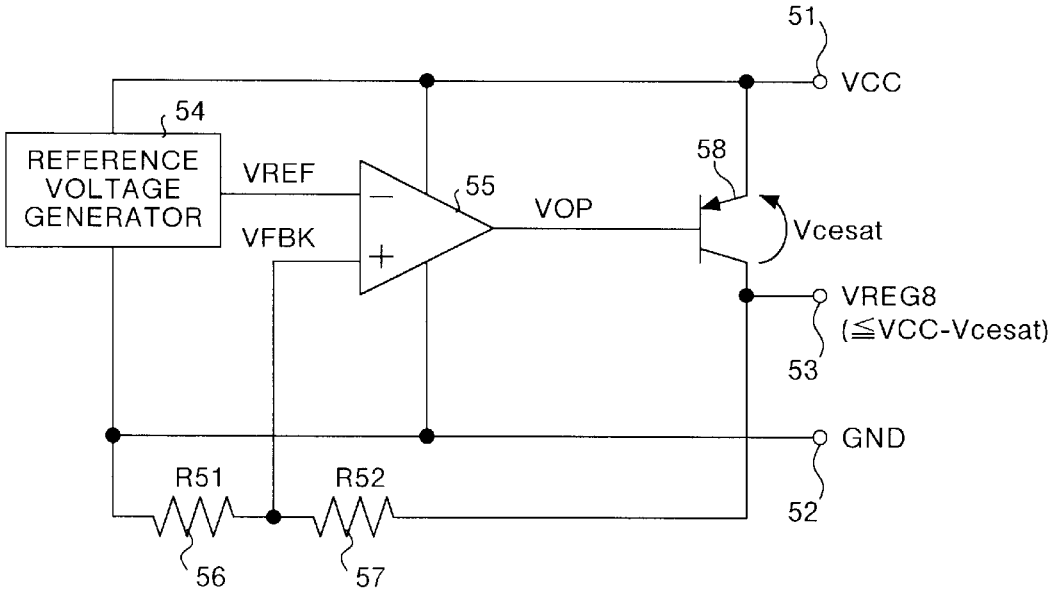
FIG. 8 is a diagram showing a schematic structure of a conventional voltage generator.

Further, in the current generator shown in FIG. 4 and FIG. 5, a voltage generator shown in FIG. 7 and FIG. 8 may be used in place of the voltage generator 101. In other words, the voltage output terminal 53 is connected to the voltage input terminal 31, and one end of the resistor 57 is connected to the emitter of the NPN transistor 41, instead of connecting to the voltage output terminal 53. With this arrangement, it is possible to avoid the temperature dependency of the output current.

As described above, according to the third embodiment, the voltage generator 101 outputs the voltage VREG3 (or VREG4) for keeping constant the voltage at one end (the feedback terminal) of the feedback resistor 7 irrespective of temperature or power source voltage changes. The current source circuit 201 inputs the output voltage VREG3 (or VREG4) of the voltage generator 101, and outputs the output current Iout2 (or Iout3). At least one diode (the NPN transistors 41*a* to 41*b* and 40) is connected in series between the voltage output terminal 3 of the voltage generator 101 and the feedback terminal. With this arrangement, it is possible to adjust the temperature characteristic of the output voltage VREG3 (or VREG4) of the voltage generator 101. Therefore, the output current Iout2 that is constant irrespective of temperature or power source voltage changes is generated. Alternatively, it is possible to generate the output current Iout3 having a desired negative temperature characteristic.

Figure 6:
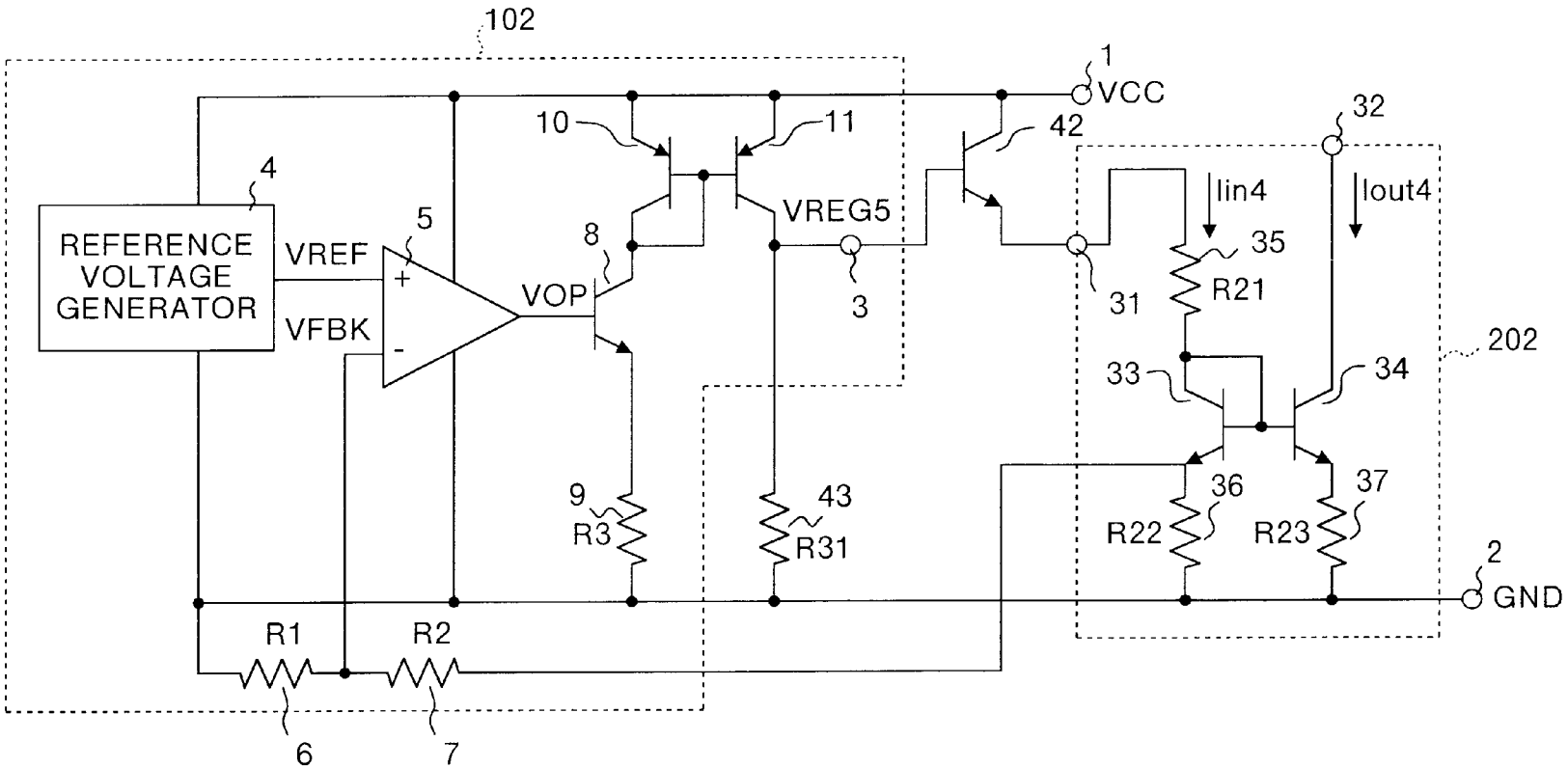
FIG. 6 is a diagram showing a schematic structure of a current generator relating to a fourth embodiment of this invention.

FIG. 6 is a diagram showing a schematic structure of a current generator relating to a fourth embodiment of this invention. Portions having the same structures as those in FIG. 3 are attached with like reference symbols. This current generator consists of a voltage generator 102 for generating a predetermined voltage, an NPN transistor 42 having a voltage output terminal 3 of the voltage generator 102 connected to a base, and having a collector connected to a high-potential side 1 of the power source, and a current source circuit 202 having a voltage input terminal 31 connected to an emitter of the NPN transistor 42, for outputting a predetermined current.

The voltage generator 102 is a one that has a resistor 43 provided between the voltage output terminal 3 and the low-potential side 2 of the power source in the voltage generator 100 of the second embodiment shown in FIG. 3. An NPN transistor 42 is provided between the voltage output terminal 3 and the voltage input terminal 31. The current source circuit 202 is a one that has a voltage input via the NPN transistor 42 in the current source circuit 200 of the second embodiment shown in FIG. 3.

The operation of the current generator relating to the fourth embodiment will be explained here. An input current Iin4 of the current source circuit 202 is supplied from a high-potential side 1 of the power source via a collector and an emitter of the NPN transistor 42. The voltage generator 102 (a collector of a PNP transistor 11) supplies a base current of the NPN transistor 42. When the current multiplication factor of the NPN transistor 42 is HFE (HFE=about 100), the base current of the NPN transistor 42 becomes a very small value of Iin4/HFE. In other words, the voltage generator 102 does not need to supply a large current. The resistor 43 is inserted for a stable operation of a feedback loop based on the securing of the collector current of the PNP transistor 11 by a predetermined volume or more (or a minimum volume).

One end of the resistor 7 is connected to an emitter of an NPN transistor 33 or an NPN transistor 34, like in the case of the second embodiment. With this arrangement, the emitter voltage of the NPN transistor 33 or the NPN transistor 34 is controlled such that the emitter voltage becomes stable independent of a power source voltage and temperature. As a result, an output current Iout4 has no temperature dependency. The voltage generator shown in FIG. 8 and FIG. 9 may be used in place of the voltage generator 102. In other words, a voltage output terminal 53 is connected to the base of the NPN transistor 42, and one end of a resistor 57 is connected to the emitter of the NPN transistor 33 or the emitter of the NPN transistor 34, without connecting to the voltage output terminal 53. With this arrangement, it is also possible to avoid the temperature dependency of the output current.

As described above, according to the fourth embodiment, the base of the NPN transistor 42 is connected to the voltage output terminal 3 of the voltage generator 102. The collector of the NPN transistor 42 is connected to the high-potential side of the power source. The current source circuit 202 inputs an output voltage VREG5 of the voltage generator 102 via the emitter of the NPN transistor 42. With this arrangement, it is not necessary that the voltage generator 102 permits a large output current. As a result, it becomes possible to simplify the voltage generator 102, and to reduce cost. Particularly, this is preferable when it is necessary to supply a large output current, like when a plurality of current source circuits are connected in parallel with the voltage generator. In this case, it is also possible to supply a necessary current without using a complex voltage generator.

FIG. 7 is a diagram showing a schematic structure of a current generator relating to a fifth embodiment of this invention. Portions having the same structures as those in FIG. 4 and FIG. 6 are attached with like reference symbols. This current generator consists of a voltage generator 103 for generating a predetermined voltage, NPN transistors 42 and 44 having a voltage output terminal 3 of the voltage generator 103 connected to respective bases, and having respective collectors connected to a high-potential side 1 of the power source, a current source circuit 203 having a voltage input terminal 31 connected to an emitter of the NPN transistor 42, for outputting a predetermined current, and an NPN transistor 41 connected in diode between the NPN transistor 44 and a feedback resistor 7.

The voltage generator 103 is a one that has a resistor 43 provided between the voltage output terminal 3 and the low-potential side 2 of the power source in the voltage generator 101 of the third embodiment shown in FIG. 4. An NPN transistor 42 is provided between the voltage output terminal 3 and the voltage input terminal 31. Further, an NPN transistor 44 is provided between the voltage output terminal 3 and the NPN transistor 41. The current source circuit 203 is a one that has a voltage input via the NPN transistor 42 in the current source circuit 201 of the third embodiment shown in FIG. 4.

The operation of the current generator relating to the fifth embodiment will be explained here. An input current Iin5 of the current source circuit 203 is supplied from a high-potential side 1 of the power source via a collector and an emitter of the NPN transistor 42. A current I2 that flows through the NPN transistor 41 is supplied from the high-potential side 1 of the power source via a collector and an emitter of the NPN transistor 44. The voltage generator 103 (a collector of a PNP transistor 11) supplies base currents of the NPN transistors 42 and 44.

When the current multiplication factor of the NPN transistors 42 and 44 is HFE (HFE=about 100), the base currents of the NPN transistors 42 and 44 become very small values of Iin4/HFE and I2/HFE respectively. In other words, the voltage generator 103 does not need to supply a large current. The resistor 43 is inserted for a stable operation of a feedback loop based on the securing of the collector current of the PNP transistor 11 by a predetermined volume or more (or a minimum volume).

When (R21+R22) and (R1+R2) are of the same values, and also when the base/emitter voltages are set the same by matching the sizes of the NPN transistors 33, 41, 42 and 44, the operation becomes similar to that of the third embodiment. The current I2 becomes equal to the current Iin5, and the output current Iout5 has no temperature dependency. Further, like in the third embodiment, a plurality of diodes (NPN transistors 41*a* to 41*b*) may be connected in series with the NPN transistor 41. With this arrangement, it is possible to obtain an output current of a desired temperature characteristic.

Figure 9:
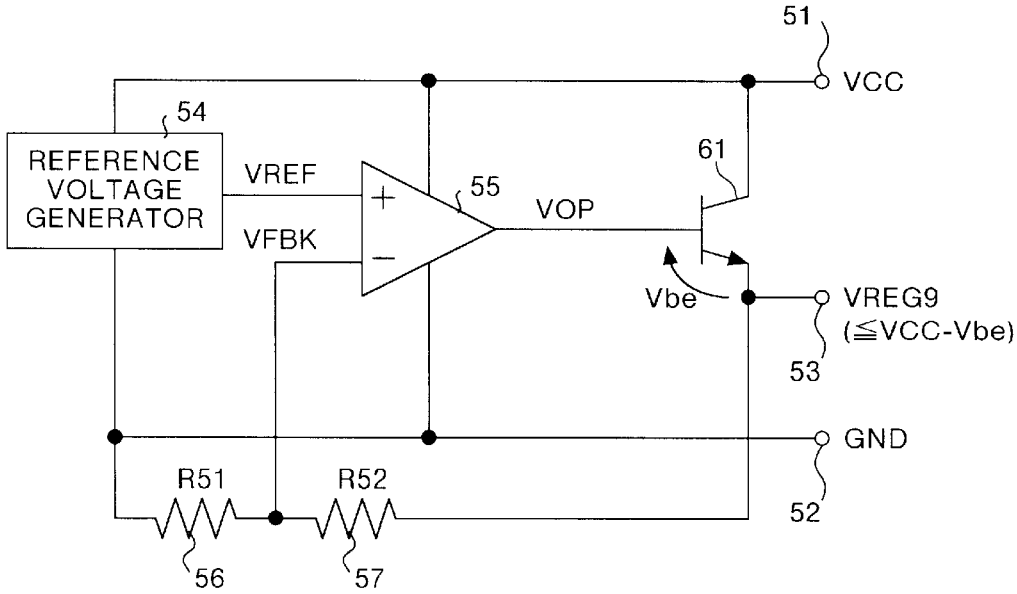
FIG. 9 is a diagram showing a schematic structure of another conventional voltage generator.
Figure 10:
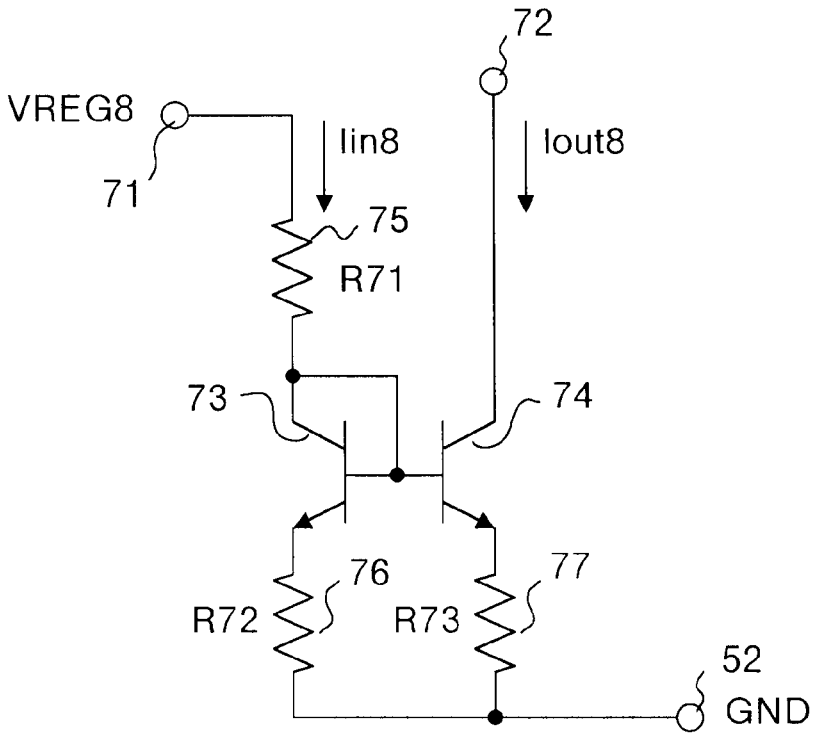
FIG. 10 is a diagram showing a schematic structure of a conventional current source circuit.

Further, a voltage generator shown in FIG. 8 and FIG. 9 may be used in place of the voltage generator 103. In other words, the voltage output terminal 53 is connected to the bases of the NPN transistors 42 and 44, and one end of the resistor 57 is connected to the emitter of the NPN transistor 41, instead of connecting to the voltage output terminal 53. With this arrangement, it is also possible to avoid the temperature dependency of the output current.

As described above, according to the fifth embodiment, the bases of the NPN transistors 42 and 44 are connected respectively to the voltage output terminal 3 of the voltage generator 103. The collectors of the NPN transistors 42 and 44 are connected respectively to the high-potential side 1 of the power source. At least one diode (a diode-connected NPN transistor 41) is provided between the emitter of the NPN transistor 44 and the feedback terminal of the voltage generator 103. The current source circuit 203 inputs an output voltage of the voltage generator 103 via the emitter of the NPN transistor 42. With this arrangement, it is not necessary that the voltage generator 103 permits a large output current. As a result, there is an effect that it becomes possible to simplify the voltage generator, and to reduce cost.

As explained above, according to one aspect of the present invention, it is not necessary that the output stage of the error detecting unit can bear a large inflow current. Furthermore, a PNP transistor of which collector/emitter saturation voltage is relatively small can flow an output current. As a result, it is possible to reduce cost, and to expand the set range of the output voltage.

According to another aspect of the present invention, a voltage of the terminal for determining an output current can be maintained at a constant level irrespective of temperature or power source voltage changes. As a result, it is possible to generate a current that is constant irrespective of temperature or power source voltage changes.

According to still another aspect of the present invention, a voltage between the emitter of the first NPN transistor and the second resistor can be maintained at a constant level irrespective of temperature or power source voltage changes. As a result, it is possible to generate a current that is constant irrespective of temperature or power source voltage changes.

According to still another aspect of the present invention, it is not necessary that the voltage generator permits a large output current. As a result, it is possible to simplify the voltage generator, and to reduce cost.

According to still another aspect of the present invention, it is possible to adjust the temperature characteristic of an output voltage of the voltage generator. As a result, a current that is constant irrespective of temperature or power source voltage changes is generated. In addition, it is possible to generate a current of a desired negative temperature characteristic.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A voltage generator comprising:

an NPN transistor for flowing a current corresponding to a voltage output from an error detecting unit;

a current mirror unit having a PNP transistor, for flowing a current that is a multiple of the current that the NPN transistor flows using the PNP transistor; and a resistor for generating a feedback voltage to the error detecting unit from an output voltage generated based on a current that the current mirror unit flows.

2. A voltage generator comprising:

a reference voltage output unit which outputs a constant reference voltage irrespective of temperature or power source voltage changes;

an error detecting unit having an output of the reference voltage output unit connected to one input;

an NPN transistor having a base, an emitter, and a collector, wherein the base is connected to an output of the error detecting unit;

a first resistor connected between the emitter of the NPN transistor and a low-potential side of the power source;

a first PNP transistor having a base, an emitter, and a collector, wherein the collector and the base are connected to the collector of the NPN transistor, and the emitter is connected to a high-potential side of the power source;

a second PNP transistor having a base, an emitter, and a collector, wherein the base is connected to the base of the first PNP transistor, and the emitter is connected to the high-potential side of the power source;

a second resistor connected between the collector of the second PNP transistor and the other input of the error detecting unit; and a third resistor disposed between the other input of the error detecting unit and the low-potential side of the power source.

3. An output circuit for an error detector, comprising:

a voltage input terminal where an output voltage of the error detector is inputted;

a voltage-current converting unit including an NPN transistor that generates a first current based on the voltage inputted from the voltage input terminal;

a current mirror unit having at least two PNP transistors, that generates a second current that is a multiple of the first current; and an output terminal that outputs the second current.

4. An output circuit for an error detector, according to claim 3, wherein the NPN transistor has a base connected to the input terminal, the voltage-current converting unit includes a first resistor connected between an emitter of the NPN transistor and a low-potential side of the power source, the current mirror circuit includes a first PNP transistor having a base, an emitter, and a collector, wherein the collector and the base are connected to a collector of the NPN transistor, and the emitter is connected to a high-potential side of the power source, and a second PNP transistor having a base, an emitter, and a collector, wherein the base is connected to the base of the first PNP transistor, and the emitter is connected to the high-potential side of the power source.

5. A current generator comprising:

a voltage generator which outputs a voltage that keeps a voltage of a feedback terminal constant irrespective of temperature or power source voltage changes;

a first resistor having one end connected to a voltage output terminal of the voltage generator;

a first NPN transistor having a base, an emitter, and a collector, wherein the collector and the base are connected to the other end of the first resistor;

a second resistor provided between the emitter of the first NPN transistor and a low-potential side of the power source;

a second NPN transistor having a base, an emitter, and a collector, wherein the base is connected to the base of the first NPN transistor; and a third resistor provided between the emitter of the second NPN transistor and the low-potential side of the power source, wherein the feedback terminal of the voltage generator is connected between the emitter of the first NPN transistor and the second resistor.

6. The current generator according to claim 5, further comprising a third NPN transistor having a base, an emitter, and a collector, wherein the base is connected to the voltage output terminal of the voltage generator, and the collector is connected to a high-potential side of the power source, wherein the current source circuit inputs an output voltage of the voltage generator via the emitter of the third NPN transistor.

7. A current generator comprising:

a voltage generator which outputs a voltage that keeps a voltage of a feedback terminal constant irrespective of temperature or power source voltage changes;

a first resistor having one end connected to a voltage output terminal of the voltage generator;

a first NPN transistor having a base, an emitter, and a collector, wherein the collector and a base are connected to the other end of the first resistor;

a second resistor provided between the emitter of the first NPN transistor and a low-potential side of the power source;

a second NPN transistor having a base, an emitter, and a collector wherein the base is connected to the base of the first NPN transistor; and a third resistor provided between the emitter of the second NPN transistor and the low-potential side of the power source, wherein the feedback terminal of the voltage generator is connected between the emitter of the second NPN transistor and the third resistor.

8. The current generator according to claim 7, further comprising a third NPN transistor having a base, an emitter, and a collector, wherein the base is connected to the voltage output terminal of the voltage generator, and the collector is connected to a high-potential side of the power source, wherein the current source circuit inputs an output voltage of the voltage generator via the emitter of the third NPN transistor.

9. A current generator comprising:

a voltage generator which outputs a voltage that keeps a voltage of a feedback terminal constant irrespective of temperature or power source voltage changes;

at least one diode connected in series between the voltage output terminal of the voltage generator and the feedback terminal of the voltage generator;

a first resistor having one end connected to a voltage output terminal of the voltage generator;

a first NPN transistor having a base, an emitter, and a collector, wherein the collector and a base are connected to the other end of the first resistor;

a second resistor provided between the emitter of the first NPN transistor and a low-potential side of the power source;

a second NPN transistor having a base, an emitter, and a collector, wherein the base is connected to the base of the first NPN transistor; and a third resistor provided between the emitter of the second NPN transistor and the low-potential side of the power source.

10. The current generator according to claim 9, further comprising a third NPN transistor and a fourth NPN transistor each having a base, an emitter, and a collector, wherein the base is connected to the voltage output terminal of the voltage generator, and the collector is connected to a high-potential side of the power source, wherein the current source circuit inputs an output voltage of the voltage generator via the emitter of the third NPN transistor, and the at least one diode is provided between the emitter of the fourth NPN transistor and the feedback terminal of the voltage generator.

11. A voltage generator comprising:

an error detecting unit that outputs a voltage;

a voltage-current converting unit including an NPN transistor that generates a first current based on the voltage output from the error detecting unit;

a current mirror unit having at least two PNP transistors, that generates a second current that is a multiple of the first current; and a first resistor that generates a feedback voltage to the error detecting unit based on the second current.

12. The voltage generator according to claim 11, further comprising:

a reference voltage output unit which outputs a reference voltage irrespective of temperature or variation of power source voltage; and a second resistor connected between the first resistor and the low potential, wherein the error detecting unit has a first input to which the reference voltage is supplied and a second input to which the feedback voltage is supplied.

13. A current generator comprising:

a voltage generator including:

a reference voltage output unit which outputs a reference voltage irrespective of temperature or variation of power source voltage;

an error detecting unit which detects error using the reference voltage and outputs a first voltage; and an output circuit for the error detecting unit which outputs a current based on the first voltage; and a current source circuit including:

a first circuit which generates a second voltage based on the output of the output circuit;

a terminal which outputs a feedback voltage based on the second voltage to the error detecting unit; and a second circuit which is connected to the first circuit and generates an output current.

14. The current generator according to claim 13, further comprising;

an NPN transistor connected between the voltage generator and the current source circuit; and a resistor electrically connected between the output of the output circuit and a low potential, wherein the NPN transistor has a base which is connected to the output of the output circuit, a collector which is connected to a high potential and an emitter which is connected to the first circuit of the current source circuit.

15. The current generator according to claim 13, wherein the first circuit includes:

a first resistor which has an input end connected to an output terminal of the voltage generator;

a first NPN transistor which has a collector and a base, each connected to an output end of the first resistor; and a second resistor which is connected between an emitter of the first transistor and a low potential, wherein the terminal which outputs the feedback voltage is connected to a node between the emitter of the first transistor and the second resistor, and wherein the second circuit includes:

a second NPN transistor which has a collector connected to a current output terminal and a base connected to the base of the first NPN transistor; and a third resistor connected between an emitter of the second NPN transistor and the low potential.

16. The current generator according to claim 13, wherein the first circuit includes:

a first resistor which has an input end connected to an output terminal of the voltage generator;

a first NPN transistor which has a collector and a base, each connected to an output end of the first resistor; and a second resistor which is connected between an emitter of the first transistor and a low potential, and the second circuit includes:

a second NPN transistor which has a collector connected to a current output terminal and a base connected to the base of the first NPN transistor; and a third resistor connected between an emitter of the second NPN transistor and the low potential, and wherein the terminal which outputs the feedback voltage is connected between the emitter of the second transistor and the third resistor.

17. A current generator comprising:

a voltage generator including:

a reference voltage output unit which outputs a reference voltage irrespective of temperature or variation of power source voltage;

an error detecting unit which detects error using the reference voltage and outputs a first voltage; and an output circuit for the error detecting unit which outputs a current based on the first voltage;

a current source circuit including:

a first circuit which generates a second voltage based on the output of the output circuit; and a second circuit which is connected to the first circuit and generates an output current; and at least one diode connected in series between the output of the voltage generator and the error detecting unit so as to generate a feedback voltage based on the output of the voltage generator.

18. The current generator according to claim 17, wherein the first circuit includes:

a first resistor which has an input end connected to an output terminal of the voltage generator;

a first NPN transistor which has a collector and a base each connected to an output end of the first resistor; and a second resistor which is connected between an emitter of the first transistor and a low potential, and the second circuit includes:

a second NPN transistor which has a collector connected to a current output terminal;

a base connected to the base of the first NPN transistor; and a third resistor connected between an emitter of the second NPN transistor and the low potential.

* * * * *